US005883322A

United States Patent [19]

Baker

[11] Patent Number: 5,883,322

[45] Date of Patent: Mar. 16, 1999

[54] FEEDBACK MINIMIZING DEVICE

[76] Inventor: Michael R. Baker, 2734 Gordon Ave., Minden, Nev. 89423

[21] Appl. No.: 758,046

[22] Filed: Nov. 27, 1996

Related U.S. Application Data

[60] Provisional application No. 60/007,632 Nov. 28, 1995.

[51] Int. Cl.[6] ..... G10G 3/00

[52] U.S. Cl. ..... 84/453; 84/743; 84/723

[58] Field of Search ..... 84/453, 743, 723, 84/725, 726, 727, 733

[56] References Cited

U.S. PATENT DOCUMENTS

| | | | |
|---|---|---|---|
| 4,024,788 | 5/1977 | Dunlap | 84/267 |
| 4,394,830 | 7/1983 | Damiano | 84/1.15 |
| 4,632,003 | 12/1986 | Kopp | 84/1.16 |
| 4,649,793 | 3/1987 | Blackshear et al. | 84/453 |
| 4,748,886 | 6/1988 | De Byl | 84/1.14 |

*Primary Examiner*—William M. Shoop, Jr.
*Assistant Examiner*—Kim Lockett
*Attorney, Agent, or Firm*—Limbach & Limbach LLP; Seong-Kun Oh

[57] ABSTRACT

A feedback eliminating device for acoustical instruments is designed to be used with in-hole amplification devices, without the need to modify either the instrument or the amplification device. The device is preferably in the form of a two-piece cover for the sound hole of an acoustical instrument. Used in conjunction with an in-hole amplification device, the device completely covers the sound hole of an acoustical instrument.

20 Claims, 3 Drawing Sheets

FEEDBACK MINIMIZING DEVICE

This application claims the benefit of U.S. Provisional application No. 60/007,632, filed Nov. 28, 1995; titled "Acoustic Minimizing Feedback System"; inventor Michael R. Baker.

BACKGROUND

Acoustic guitars are often amplified during performances. Typically this amplification is accomplished by holding the guitar adjacent a stationary microphone during the performance, or actually mounting a small microphone on the face of the guitar near the "sound hole."

Another approach is to mount a microphone in the sound hole itself. An example of an "in-hole" pick-up is the Pro-Mag brand pick-up, sold by Dean Markley.

Feedback is a problem when an acoustic guitar is amplified using any of these microphones. Specifically, "tone rollover," a feedback phenomena, is common at frequencies of 160 mH, 400 mH, and 1K. This feedback produces an undesirable buzz or hum, and is unpredictable and common when acoustical instruments are amplified.

Certain devices have been described which can reduce or eliminate this feedback. U.S. Pat. No. 4,394,830 to Damiano describes a plug to cover the sound hole of an acoustic guitar. The plug completely covers the hole. In one embodiment, a magnetic pick-up is integrated into the plug.

The plug of the '830 patent cannot, however, be used with in-hole amplification devices which are designed to fit into the sound hole, such as the Dean Markley Pro-Mag device. Thus, there is a need for a feed back controlling device which would permit the use of an in-hole microphone.

SUMMARY OF THE INVENTION

The present invention is a feedback eliminating device in the form of a two-piece embodiment adapted to snugly fit in the sound hole of an acoustical instrument adjacent an in hole amplification device. The feedback eliminating device is designed as a universal device for all standard sized round holes in acoustical instruments and models for different types of acoustical instruments will be of similar design. The device is made up of two pieces comprised of a cup portion attached to a lip portion to cover the opening of the sound hole and for securing the device in place.

With this device inserted in the sound hole adjacent a "pick-up" microphone, feedback is eliminated. The primary advantage of this device is that it eliminates feedback when the instrument is used with an in-hole amplification device. The device eliminates feedback without the need to modify the instrument or the in-hole amplification device.

In its broadest form, the device of the invention is a cover for an acoustical instrument sound hole comprising a first hole cover portion which has a side wall, a lip portion connected to an upper portion of the side wall, and a bottom wall connected to a lower portion of the side wall. In this embodiment, the side wall forms an arc having a length less than the arc length of a semicircle having a radius which is the same as that of the arc of the side wall. The device further includes a second hole cover portion including a side wall, a lip portion connected to an upper portion of the side wall, and a bottom wall connected to a lower portion of the side wall. Like the first hole cover portion, the side wall of the second hole cover portion forms an arc having a length less than the arc length of a semicircle having a radius which is the same as that of the arc of the side wall. In this way, the two hole cover portions will form a cover which matches the shape of an in-hole microphone to completely cover the sound hole of the instrument.

BRIEF DESCRIPTION OF THE DRAWINGS

The invention will be better understood by reference to the appended drawings of which.

DETAILED DESCRIPTION

The device of the present invention may be used to eliminate feedback when acoustical instruments are used with in-hole amplification devices. The feedback eliminating device is designed to permit the use of in-hole amplification devices without the modification of either the device or the instrument. The device allows persons playing the instrument to move around during a performance without fear of the feedback which might otherwise arise from the "pick up" microphone.

The feedback eliminating device is designed as a universal device for all standard sized round holes in acoustical instruments. Models for different types of acoustical instruments are of similar design. The feedback eliminating device fits snugly into the sound hole of the instrument, on both sides of an in-hole amplification device. The feedback eliminating device is designed so that it may be easily installed and removed. Used in conjunction with an in-hole amplification device, the feedback eliminating device and the amplification device together completely cover the sound hole of an acoustical instrument.

Figure 1:
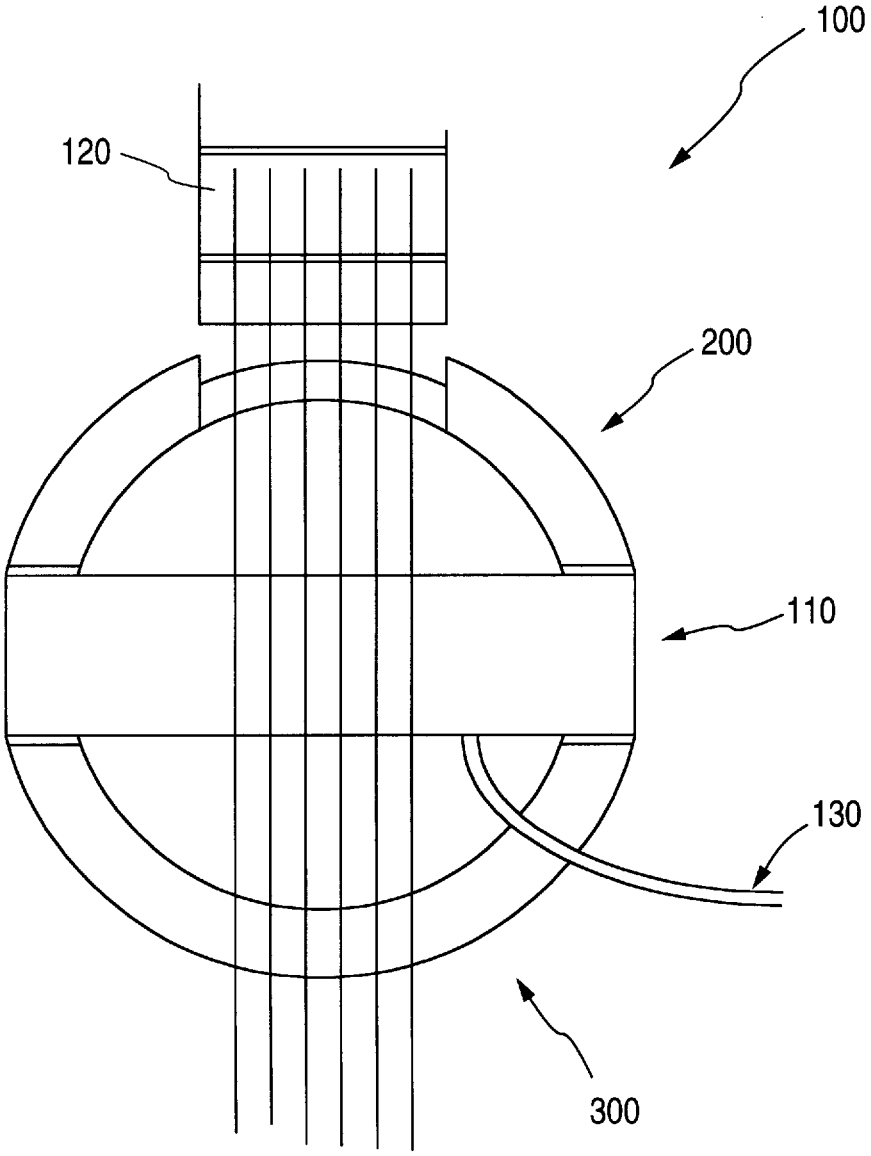
FIG. 1 shows a top plan view of one embodiment of the feedback elimination device installed in an acoustic guitar sound hole with a "pick up" microphone.

FIG. 1 shows a preferred embodiment of the feedback eliminating device 100 installed in an acoustic guitar sound hole together with a "pick-up" microphone 110 such as a Dean Markley Pro-Mag. The feedback eliminating device includes a top half 200 and a bottom half 300, both of which fit snugly into the sound hole of the instrument.

Figure 2A:
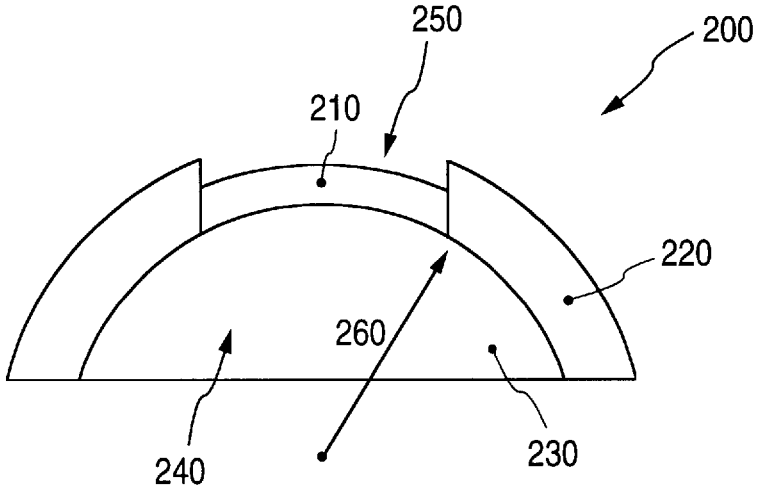
FIG. 2A shows a top plan view of the top portion of the feedback elimination device in FIG. 1.
Figure 2B:
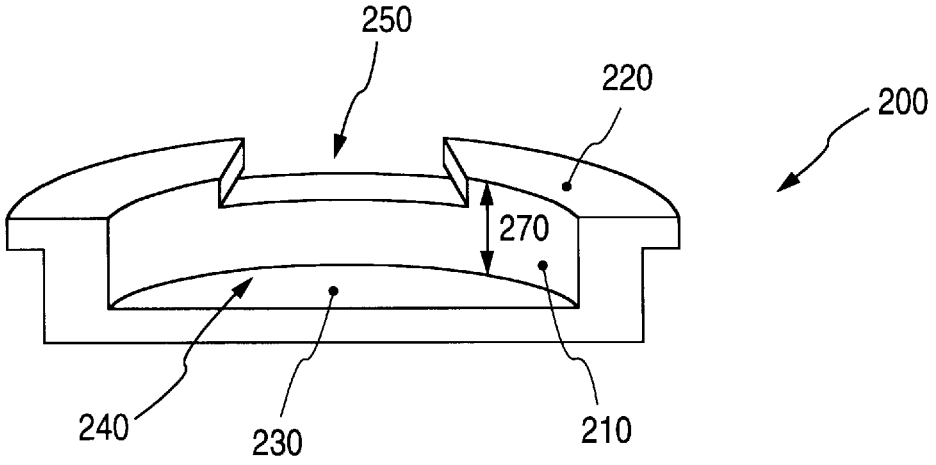
FIG. 2B shows a top perspective view of the top portion of the feedback elimination device in FIG. 1.

FIGS. 2A and 2B show plan and perspective views of the top half 200 of the feedback eliminating device. The top half 200 includes a side wall 210, a lip portion 220 and a bottom wall 230. The side wall 210 and bottom wall 230 define a cup potion 240. The lip portion 220 extends radially outward from the cup portion 240. In operation, the lip portion 220 rests on the surface of the instrument to keep the cover from being pushed completely into the sound hole. The cup portion 240 fits into the sound hole so that the cover fits snugly as the frictional forces between the cover and the sound hole prevent the cover from falling out easily. When installed, the top half 200 permits the neck of the instrument (120, FIG. 1) to fit without interference as the lip portion 220 is discontinuous 250. The top half 200 also has a slight 1° offset to permit proper acoustical tuning across all key ranges. In a preferred embodiment the side wall 210 is about 0.3" thick, the bottom wall 230 is about 0.175" thick, and the lip portion 220 is about 0.475" wide and 0.1" thick. In this embodiment the radius of curvature of the side wall 260 is about 1.7" and the depth of the cup portion 270 is about 0.35".

Figure 3A:
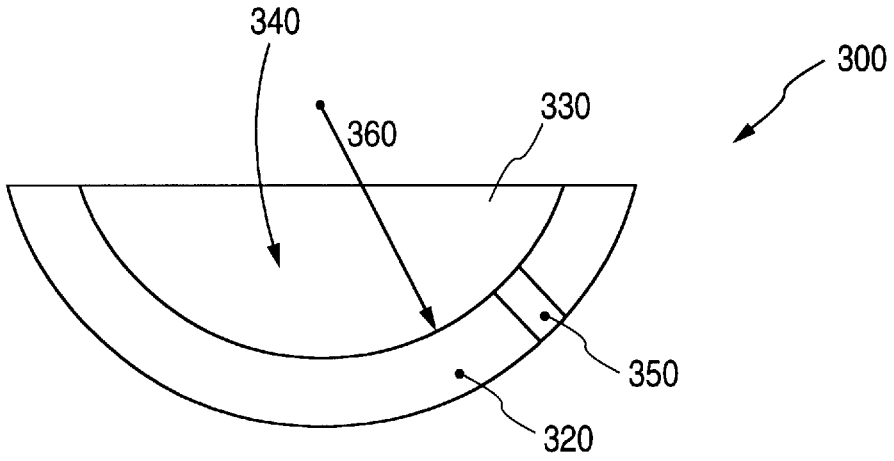
FIG. 3A shows a top plan view of the bottom portion of the feedback elimination device in FIG. 1.
Figure 3B:
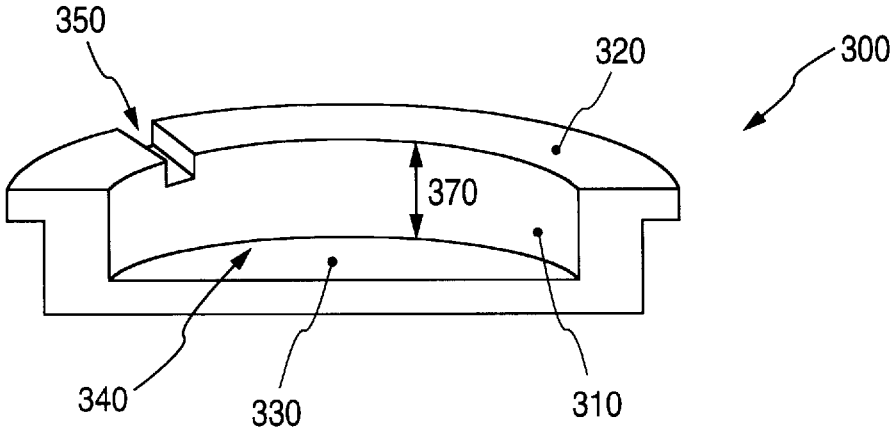
FIG. 3B shows a top perspective view of the bottom portion of the feedback elimination device in FIG. 1.

FIGS. 3A and 3B show plan and perspective views of the bottom half 300 of the feedback eliminating device. The bottom half 300 includes a side wall 310, a lip portion 320 and a bottom wall 330. The side wall 310 and bottom wall 330 define a cup potion 340. The lip portion 320 extends radially outward from the cup portion 340. In operation, the lip portion 320 rests on the surface of the instrument to keep the cover from being pushed completely into the sound hole. The cup portion 340 fits into the sound hole so that the cover fits snugly as the frictional forces between the cover and the sound hole prevent the cover from falling out easily. The bottom half 300 permits the attachment of various in hole amplification devices. The bottom half also has a notch 350 in the lip portion 320, which when the device is installed permits the electrical cord (130, FIG. 1) of the amplification device (110, FIG. 1) to pass through and be secured without interfering with the strings. In a preferred embodiment the side wall 310 is about 0.3" thick, the bottom wall 330 is about 0.175" thick, and the lip portion 320 is about 0.475" wide and 0.1" thick. In this embodiment the radius of curvature of the side wall 360 is about 1.7" and the depth of the cup portion 370 is about 0.35".

The cover may be made of any material which is adequately flexible to be easily positioned adjacent the in-hole pick-up, but which can be fit snugly so that it will stay in place. Rubber and flexible polymeric materials can be used. A broader range of materials, such as those which are stiffer, can be used if the device is to be more permanently installed on the instrument. In a preferred embodiment, the device of the invention is made of a 76–80 density rubber.

What is claimed is:

1. A cover for an acoustical instrument sound hole, the instrument for use with an in-hole amplification device, comprising:

a first hole cover portion configured to substantially fit over a first portion of the sound hole and adjacent to a first side of the in-hole amplification device the first hole cover portion including a first side wall, a first lip portion connected to a first upper portion of the first side wall, and a first bottom wall connected to a lower portion of the first side wall, the first side wall forming an arc having a length less than the arc length of a semicircle having a radius which is the same as that of the arc of the first side wall; and a second hole cover portion configured to substantially fit over a second portion of the sound hole and adjacent to a second side of the in-hole amplification device the second hole cover portion including a second side wall, a second lip portion connected to a second upper portion of the second side wall, and a second bottom wall connected to a lower portion of the second side wall, the second side wall forming an arc having a length less than the arc length of a semicircle having a radius which is the same as that of the arc of the second side wall.

2. The cover for an acoustical instrument sound hole of claim 1 wherein the first lip portion includes a cutout portion sized to accommodate a neck of the instrument.

3. The cover for an acoustical instrument sound hole of claim 1 wherein one of said first and second lip portions includes a groove sized to accommodate the cord of the in-hole amplification device.

4. The cover for an acoustical instrument sound hole of claim 1 wherein each of the first and second lip portions extends radially outward from the respective first and second side walls and the first and second bottom walls respectively extend inwardly from the respective first and second side walls.

5. The cover for an acoustical instrument sound hole of claim 1 wherein the first and second hole cover portions are formed from flexible polymeric material.

6. The cover for an acoustical instrument sound hole of claim 5 wherein the first and second hole cover portions are formed from rubber.

7. The cover for an acoustical instrument sound hole of claim 1 wherein the arc length of the first side wall is the same as the arc length of the second side wall.

8. The cover of claim 1 wherein said first and second bottom walls are each formed in the shape of a segment of a circle.

9. A cover for an acoustical instrument sound hole arranged for use with an in-hole amplification device, consisting of:

a first hole cover portion configured to substantially fit over a first portion of the sound hole and adjacent to a first side of the in-hole amplification device, the first hole cover portion including a first side wall, a first lip portion connected to a first upper portion of the first side wall, and a first bottom wall connected to a lower portion of the first side wall, the first side wall forming an arc having a length less than the arc length of a semicircle having a radius which is the same as that of the arc of the first side wall; and a second hole cover portion configured to substantially fit over a second portion of the sound hole and adjacent to a second side of the in-hole amplification device, the second hole cover portion including a second side wall, a second lip portion connected to a second upper portion of the second side wall, and a second bottom wall connected to a lower portion of the second side wall, the second side wall forming an arc having a length less than the arc length of a semicircle having a radius which is the same as that of the arc of the second side wall.

10. The cover of claim 9 wherein the first lip portion includes a cutout portion sized to accommodate a neck of the instrument.

11. The cover of claim 9 wherein one of said first and second lip portions includes a groove sized to accommodate the cord of the in-hole amplification device.

12. The cover of claim 9 wherein each of the first and second lip portions extends radially outward from the respective first and second side walls, and the first and second bottom walls respectively extend inwardly from the respective first and second side walls.

13. The cover of claim 9 wherein the first and second hole cover portions are formed from flexible polymeric material.

14. The cover of claim 13 wherein the first and second hole cover portions are formed from rubber.

15. The cover of claim 9 wherein the arc length of the first side wall is the same as the arc length of the second side wall.

16. A sound hole cover to reduce feedback in an acoustical instrument having a sound hole, comprising:

an amplification device configured to substantially fit within the sound hole;

a first cover portion configured to fit substantially in a first portion of the sound hole and adjacent to a first side of the amplification device, the first cover portion including:

a first side wall having first and second ends;

a first lip portion coupled substantially perpendicular to the first side wall first end;

a first bottom wall having a radial end coupled to the first side wall second end; and a second cover portion configured to fit substantially in a second portion of the sound hole and adjacent to a second side of the amplification device, the second cover portion including:

a second side wall having first and second ends;

a second lip portion coupled substantially perpendicular to the second side wall first end;

a second bottom wall having a radial end coupled to the second side wall second end;

wherein the first and second side walls are located substantially within the sound hole of the instrument, wherein the first and second lip portions are located substantially outside of the sound hole, and further, wherein said first and second cover portions and said amplification device together substantially cover the entire sound hole.

17. The sound hole cover of claim 16 wherein said first lip portion includes a first groove for receiving a neck portion of the instrument, and further, wherein said second lip portion includes a second groove for receiving a cord.

18. The sound hole cover of claim 16 wherein the thicknesses of the first and second side walls are approximately 0.3 inches each, the thicknesses of the first and second bottom walls are approximately 0.175 inches each, the thicknesses of the first and second lip portions are approximately 0.1 inches each, the first and second lip portions each being approximately 0.475 inches wide such that the first cup portion defined by the first side wall, the first bottom wall, and the first side of the amplification device, and the second cup portion defined b the second side wall, the second bottom wall and the second side of the amplification device, are each approximately 0.35 inches deep.

19. The sound hole cover of claim 16 wherein the first and second cover portions are formed from flexible polymeric material.

20. The sound hole cover of claim 19 wherein said polymeric material is rubber.

* * * * *